US009419371B2

(12) United States Patent
Thomas

(10) Patent No.: US 9,419,371 B2
(45) Date of Patent: Aug. 16, 2016

(54) ELECTRICAL DEVICE COVER ASSEMBLY WITH CORD RETENTION

(71) Applicant: Hubbell Incorporated, Shelton, CT (US)

(72) Inventor: Jason P. Thomas, Mesa, AZ (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/462,222

(22) Filed: Aug. 18, 2014

(65) Prior Publication Data

US 2015/0056850 A1 Feb. 26, 2015

Related U.S. Application Data

(60) Provisional application No. 61/868,237, filed on Aug. 21, 2013.

(51) Int. Cl.

| | |
|---|---|
| ***H01R 13/52*** | (2006.01) |
| ***H01R 13/58*** | (2006.01) |
| *H01R 24/78* | (2011.01) |
| *H01R 25/00* | (2006.01) |

(52) U.S. Cl.

CPC ..... *H01R 13/5213* (2013.01); *H01R 13/5812* (2013.01); *H01R 24/78* (2013.01); *H01R 25/006* (2013.01)

(58) Field of Classification Search

CPC ..... H01R 25/006

USPC ..... 174/67, 66; 220/242

See application file for complete search history.

(56) References Cited

U.S. PATENT DOCUMENTS

| | | | | |
|---|---|---|---|---|
| 4,424,407 A * | 1/1984 | Barbic | H01R 13/447 174/67 |
| 4,851,612 A * | 7/1989 | Peckham | 174/67 |
| 5,389,740 A * | 2/1995 | Austin | H02G 3/14 174/67 |
| 6,133,531 A * | 10/2000 | Hayduke | H02G 3/081 174/67 |
| 8,013,245 B2 * | 9/2011 | Korcz | H02B 1/52 174/53 |

* cited by examiner

*Primary Examiner* — Dhirubhai R Patel

(57) ABSTRACT

A weatherproof cover assembly for an electrical wiring device such as an electrical receptacle includes a base having a front face and an opening in the front face for receiving the face of the electrical wiring device. A cover is hinged to the base to pivot between an open position and a closed position covering the electrical wiring device. The cover assembly includes a first cord retention member proximate a first side of the cover assembly 10 having an opening with a dimension for gripping an electrical cord and a second cord retention member proximate a second side of the cover assembly with an opening with a dimension for gripping the electrical cord. The cord retention member can be a hook formed on the base and spaced outwardly from the cover or a slot formed in the peripheral edge of the cover.

19 Claims, 7 Drawing Sheets

ELECTRICAL DEVICE COVER ASSEMBLY WITH CORD RETENTION

CROSS REFERENCE TO RELATED APPLICATION

This application claims the benefit under 35 U.S.C. §119 (e) of U.S. Provisional Application Ser. No. 61/868,237, filed Aug. 21, 2013, which is hereby incorporated by reference in its entirety.

FIELD OF THE INVENTION

The present invention is directed to a cover assembly for an electrical device having a cord retention member. The invention is particularly directed to a cover assembly for an electrical device, such as an electrical receptacle, having a cord retention hook for receiving and retaining an electrical cord.

BACKGROUND OF THE INVENTION

Electrical receptacles that receive an electrical plug or other connection are prone to being inadvertently separated by pulling on the electrical plug. Weatherproof covers for outside use are known to have a strain relief member to engage the cord to prevent strain on the plug and the connection between the cord and the plug.

Various devices have been proposed for gripping the cord to prevent accidental separation of the cord and plug from the electrical receptacle during use. The cord retention members in the form of a hook on the cover or base hook onto the cord to resist separation of the plug from the electrical receptacle.

One example of such a device of a cord securing cover for an electrical outlet is disclosed in U.S. Pat. No. 8,012,174 to Schutte. The cover is hinged to the base and has a hook member formed on the outer face of the cover. The hook-like member has a prong extending parallel to the plane of the outer face of the cover and is spaced from the cover for receiving a cord. D628,044, D628,045 and D628,046 disclose a similar design of a cord hook on the cover.

U.S. Pat. No. 5,533,637 to Williams discloses a weatherproof enclosure where the cover has a top face and sidewalls extending from the sidewalls. One of the sidewalls has a plurality of U-shaped recesses for allowing the cord to pass through when the cover is in the closed position without interfering with the closing of the cover.

U.S. Pat. No. 6,552,692 to Conner discloses an outlet cover that snaps onto a base to enclose an electrical outlet. The cover has sidewalls with removable tabs or knockouts to allow the cord to pass through the cover when the cover is attached to the base.

U.S. Pat. No. 7,538,272 to Shotey et al. discloses a weatherproof cover plate where the cover plate has a notch in a sidewall forming a cord hook for receiving the cord when the cover is in the closed position. The hinged cover closes over the edge of the cover plate so that the cord hook is closed by the cover when the cover is closed.

U.S. Pat. No. 8,013,245 to Korcz et al. discloses a weatherproof cover assembly where the base has an inner cavity for receiving a cord and plug and a recessed portion in the top edge of the wall of the cover assembly for allowing the electrical cord to pass through when the cover is in the closed position. A hook-like member is spaced outwardly from the recessed portion and sidewall of the base to receive the cord and hold the cord in the recess during use. The cover is hinged to cover the base and the hook-like members when the cover is closed.

While these devices are generally suitable for their intended purpose, there is a continuing need in the industry for improved covers having a cord retaining device.

SUMMARY OF THE INVENTION

The present invention is directed to a weatherproof cover assembly for an electrical device having a cord retention member. The invention is particularly directed to a weatherproof cover assembly for an electrical receptacle where the cover assembly has at least one cord retention member for retaining the cord when the cord is coupled to the electrical receptacle.

The cover assembly of the invention is constructed for attaching to the electrical box having an electrical device such as an electrical receptacle. The cover assembly in one embodiment of the invention has a hinged cover that mates with a base to cover the electrical receptacle to provide a weatherproof cover assembly.

The present invention is particularly directed to a weatherproof cover assembly for use in wet locations where the assembly the assembly has at least one, and preferably two, cord retention members. The cover assembly has a base that is attached to an electrical box supporting an electrical device such as the electrical receptacle. The base can be coupled directly to the electrical device and/or the electrical box. The base has an opening for receiving and accessing the electrical receptacle. The cover is hinged to the base and has a dimension to cover the opening in the base and the electrical receptacle to provide a weatherproof seal over the electrical receptacle.

In one embodiment, the weatherproof cover has a substantially flat or low profile where the base is a substantially flat plate member with screw holes for attaching the base to the electrical device or electrical box. The cover can have a substantially flat configuration with an outer edge that forms a seal completely around the opening in the base and the electrical device when the cover is in the closed position.

One aspect of the invention is to provide a weatherproof cover assembly having a cord retention member for receiving and retaining the cord of a plug inserted into the electrical receptacle. The cord retention member receives the cord to prevent inadvertent disconnection of the plug with the electrical receptacle when the cover is open and to provide strain relief between the cord and the plug.

Another aspect of the invention is to provide a weatherproof cover assembly where the cover assembly has a first cord hook on a first side of the cover assembly and a second cord hook on a second side of the cover assembly. The first and second cord hooks are spaced outwardly from the opening in the base toward the outer edges of the base. The cord hooks are positioned such that the cord hooks are spaced outwardly from the opening in the base when the cover is in the closed position.

Another feature of the invention is to provide a cover assembly having a base and a hinged cover where the base has at least one cord retention member that is spaced outwardly from the outer perimeter of the cover when the cover is in the closed position. The cord retention member can be a cord hook extending outwardly from the front face of the base adjacent the cover when the cover is closed.

The cover assembly in one embodiment of the invention has a base with an opening for receiving the electrical receptacle and a hinged cover that pivots between an open position to allow access to the electrical receptacle and a closed position to cover the opening in the base and the electrical receptacle. The base can have at least one cord retention member for receiving the cord of a plug that is inserted into the electrical receptacle. The cord retention member in one embodiment of the invention is a cord hook extending outwardly from a front face of the base and positioned outside the perimeter of the cover when the cover is in the closed position. In one embodiment, two cord hooks are positioned on opposite sides of the base where the cover is received between the cord hooks when the cover is in the closed position.

The cord hook can be attached to the base where the cord hook has an opening facing outward with respect to the side edge of the base. The cord hook has a first leg extending outwardly from the front face of the base and a second leg extending away from the first leg and is spaced from the front face of the base a distance to receive and grip an electrical cord.

Another aspect of the invention is to provide a cover assembly having a base and a hinged cover where the base has a cord hook extending outwardly from the front face of the base and where the cord hook overlies a recess on the front face of the base to capture the cord.

The present invention is also directed to a cover assembly for coupling to an electrical box and overlying an electrical receptacle where the cover assembly includes a base with an opening for receiving the electrical receptacle and a hinged cover where the cover includes at least one cord retention member along a side edge of the cover and facing outwardly with respect to the side edge of the cover assembly.

The cover assembly of the invention in one embodiment has at least one notch formed in a side edge of the cover with a dimension for receiving and gripping an electrical cord. The notch formed in the side edge of the cover has a first open portion with a dimension for receiving the electrical cord and a second open portion in the side edge of the cover where the second portion has a dimension less than the first portion to retain the cord within the first open portion of the notch.

The invention is further directed to a cover assembly having a base and a cover where the cover has opposite side edges and where each edge has a cord hook for receiving an electrical cord.

The various aspects and features of the invention are attained by providing a cover assembly for an electrical wiring device comprising a base having a front face, a first side edge, a second side edge and an opening in the front face for receiving the electrical wiring device. The cover is hinged to the base and is visible between an open position to access the electrical wiring device and a closed position covering the electrical wiring device. A first cord hook is provided on the cover assembly and positioned proximate a side edge of the cover assembly where the first cord hook has an opening with a dimension for gripping an electrical cord. A second cord hook is provided on the cover assembly and is positioned proximate a second side of the cover assembly where the second cord hook has an opening with a dimension for gripping an electrical cord.

The various features of the invention are also obtained by providing a cover assembly for an electrical wiring device comprising a base having a front face, a first side edge, a second side edge and an opening in the front face for receiving the electrical wiring device. A cover has a first end hinged to the base and a second end opposite the first end. The cover is pivotable between an open position to access the electrical wiring device and a closed position covering the electrical wiring device where the cover has a first side edge proximate a first side edge of the base and a second side edge proximate the second side edge of the base. A first cord hook is provided on the first side edge of the cover and has an opening facing outwardly from the first side edge and has a dimension for gripping an electrical cord.

The features of the invention are further attained by providing a cover assembly for covering an electrical receptacle and configured for receiving an electrical cord where the cover assembly comprises a base having a front face, a rear face, a first side edge and a second side edge opposite the first side edge, a first end, a second end and an opening in the front face for receiving the electrical receptacle. A cover is pivotally coupled to the first end of the base where the cover is pivotable between an open position and a closed position to cover the opening in the base and the electrical receptacle. The cover has a first side edge and an opposite second side edge. A first cord hook is coupled to the front face of the base and spaced outwardly from the opening in the base and spaced outwardly from the first side edge of the cover when the cover is in the closed position.

These and other aspects of the invention become apparent from the following detailed description of the invention and the drawings which discloses various embodiments of the invention.

BRIEF DESCRIPTION OF THE DRAWINGS

The following is a brief description of the drawings in which.

DETAILED DESCRIPTION OF THE INVENTION

Figure 1:
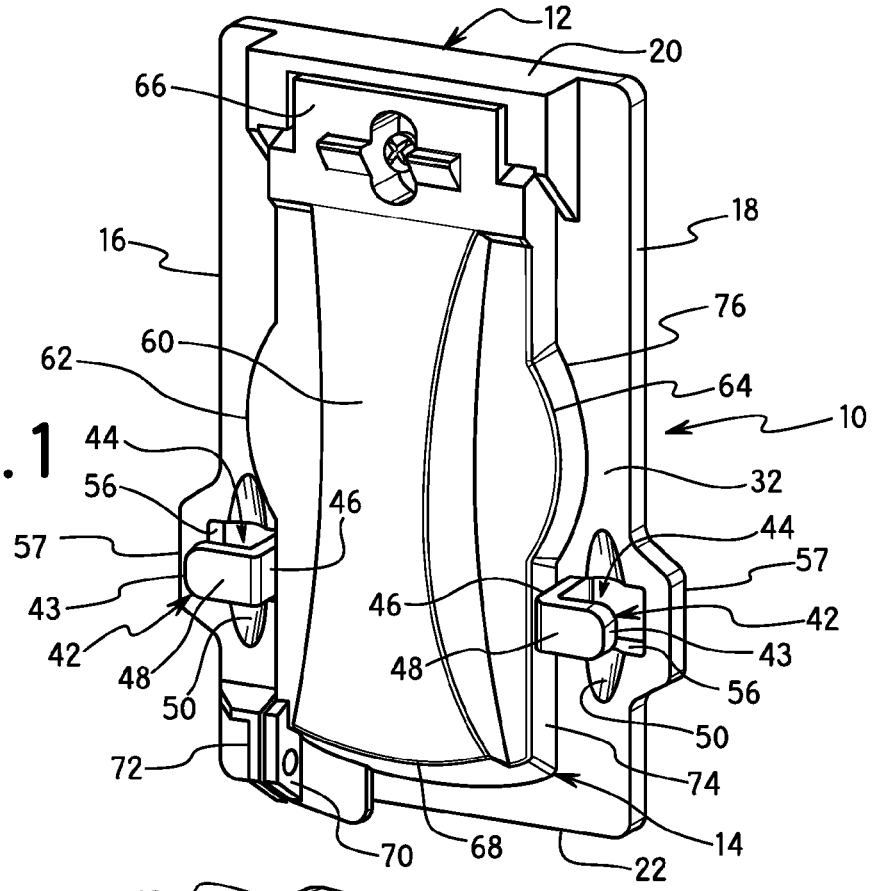
FIG. 1 is a front perspective view of the cover assembly in a first embodiment of the invention.

The present invention is directed to a cover assembly for an electrical device having at least one cord retention member. The invention is particularly directed to a cover assembly for an electrical receptacle where the cover assembly has at least one cord retention member for providing strain relief and retaining the cord when the cord is coupled to the electrical device to reduce the risk of the cord being inadvertently pulled from the receptacle.

The cover assembly of the invention is constructed for attaching to the electrical box having an electrical device such as an electrical receptacle. The cover assembly in one embodiment of the invention has a hinged cover mating with the base to cover the electrical receptacle to provide a weatherproof cover assembly. The cover assembly has at least one cord retention member on the cover or on the base to grip a cord when connected to the electrical receptacle. The cord retention member is positioned so that the cord retention member does not interfere with the cover in the closed position and so that the cover can form a weatherproof seal around the electrical receptacle. In one preferred embodiment, the cover is able to mate with the base to form a seal around the electrical receptacle with no openings or gaps formed between the base and the cover when the cover is closed.

Referring to FIGS. 1-9, a first embodiment of the invention includes a cover assembly 10 having a base 12 and a cover 14. The cover 14 is hinged to the base 12 by a pivot pin 15 shown in FIG. 4 to pivot between the closed position shown in FIG. 1 and an open position shown in FIG. 2.

The base 12 in the embodiment illustrated has a substantially rectangular configuration with an outer edge defining a perimeter of the base. The cover assembly 10 is shown as a single gang assembly. Alternatively, the cover assembly 10 can be a two gang or multigang assembly where the base 12 and cover 14 have dimensions corresponding to the number and size of the electrical wiring devices. The base 12 has a first side edge 16 and a second side edge 18 forming first and second sides of the cover assembly 10. The cover 14 has a first end 20 at a top end of the cover assembly and a second end 22 at a bottom end of the cover assembly and extending between the first side edge 16 and second side edge 18 to define the rectangular configuration.

Figure 2:
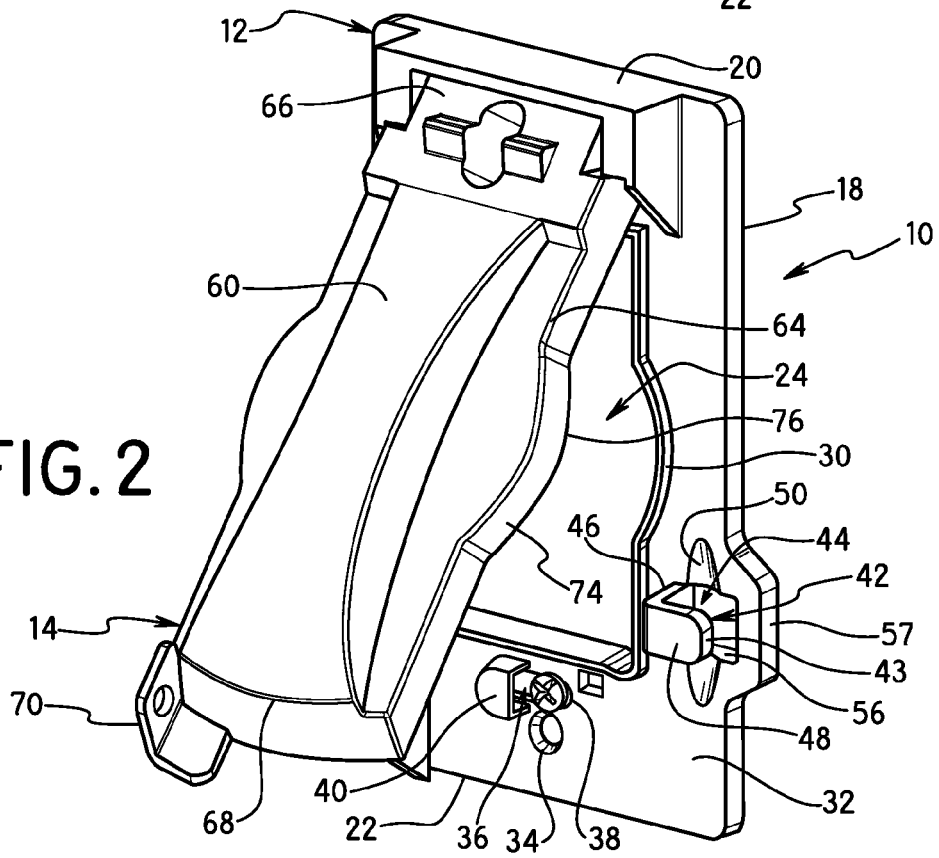
FIG. 2 is a front perspective view of the cover assembly of FIG. 1 showing the cover in the partially opened position.
Figure 3:
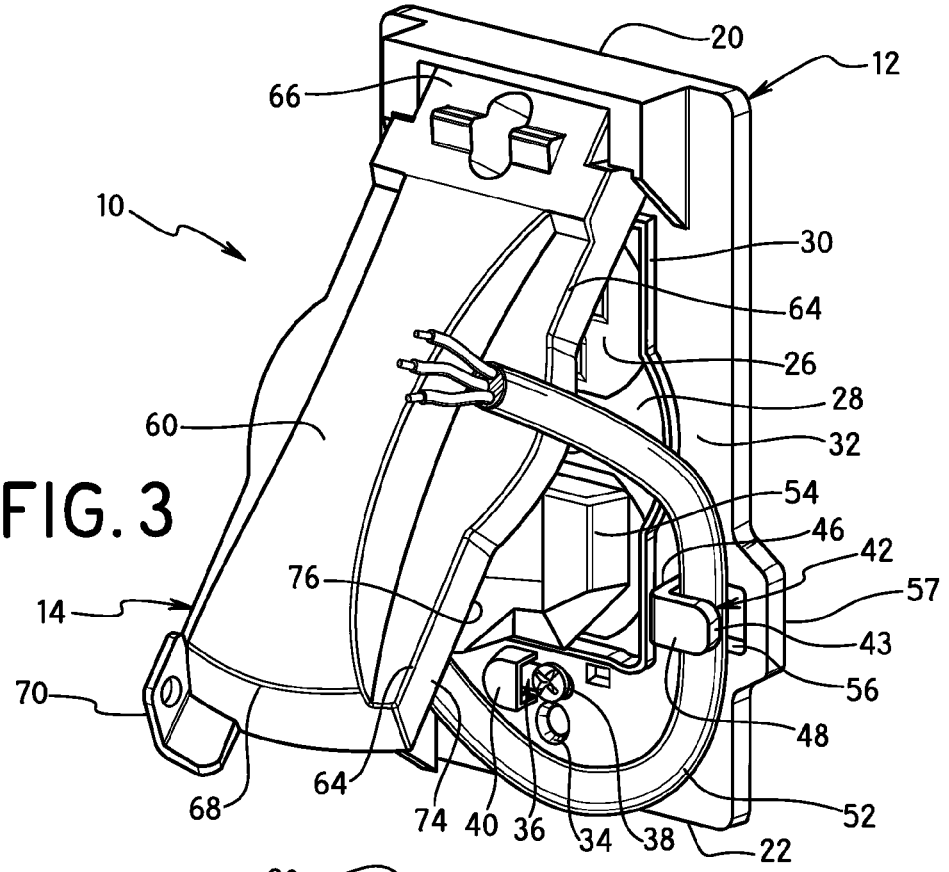
FIG. 3 is a front perspective view of the cover assembly of FIG. 1 showing a cord coupled to the cord retention member.

The base 12 has an opening 24 for receiving the front face of an electrical device such as an electrical duplex receptacle 26 shown in FIG. 3. The opening 24 generally has a dimension sufficient to receive the face of the electrical receptacle 26 and to allow access to the electrical receptacle when the cover is in the open position. As shown in FIG. 2, the opening 24 can receive an insert or adapter plate 28 having different size openings to accommodate different electrical devices and electrical receptacles.

In the embodiment shown, the opening 24 is centered in the base 12 and extends between the front face 32 and rear face 61. A continuous rib 30 extends outwardly from the outer face 32 of the base 12. The rib 30 extends outwardly a distance to deflect rain water from entering the opening 24 and to mate with the cover 14 to provide a weatherproof seal between the cover 14 and base 12. In preferred embodiments of the invention, the rib 30 is continuous to form a continuous barrier around the opening 24. Preferably, the rib 30 is provided at the opening 24 and spaced inwardly from the outer edges of the base 12.

The base 12 is attached to the electrical receptacle or to the electrical box in a manner known in the art. In the embodiment shown, the base 12 includes a screw hole 34 for receiving a mounting screw. The base 12 also includes a keyhole shaped slot 36 for receiving a mounting screw 38. In the embodiment shown, the base includes a shield 40 overlying a portion of keyhole shaped slot 36.

Figure 4:
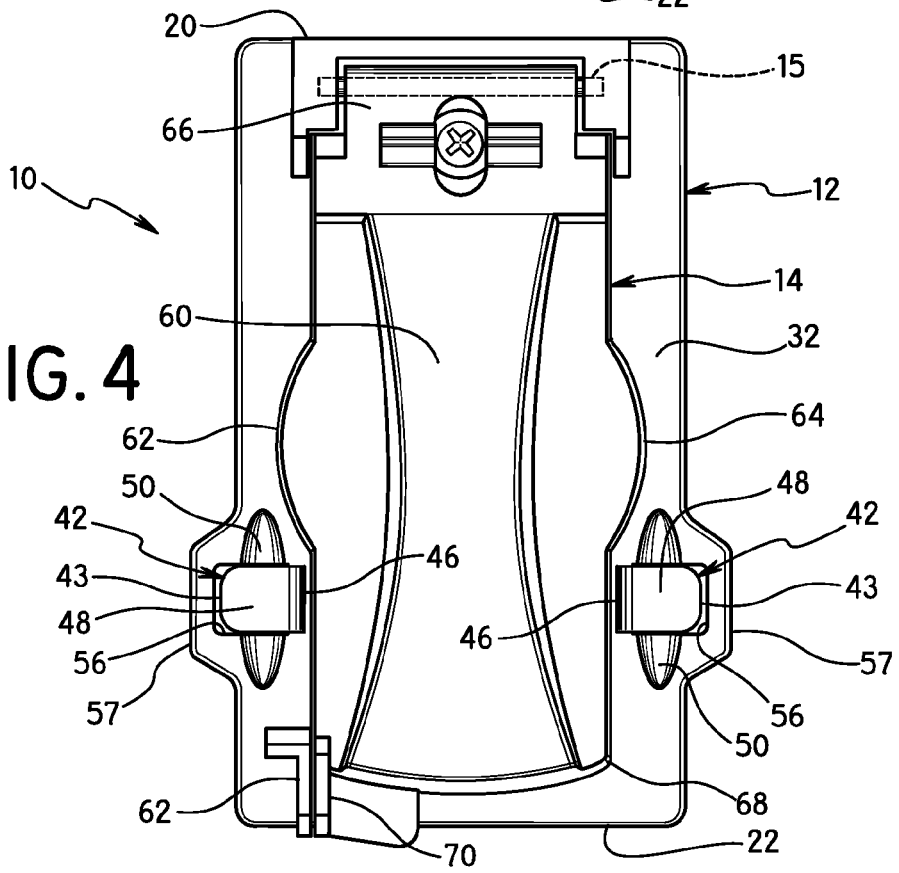
FIG. 4 is a front view of the cover assembly showing the cover between two cord retention members.
Figure 5:
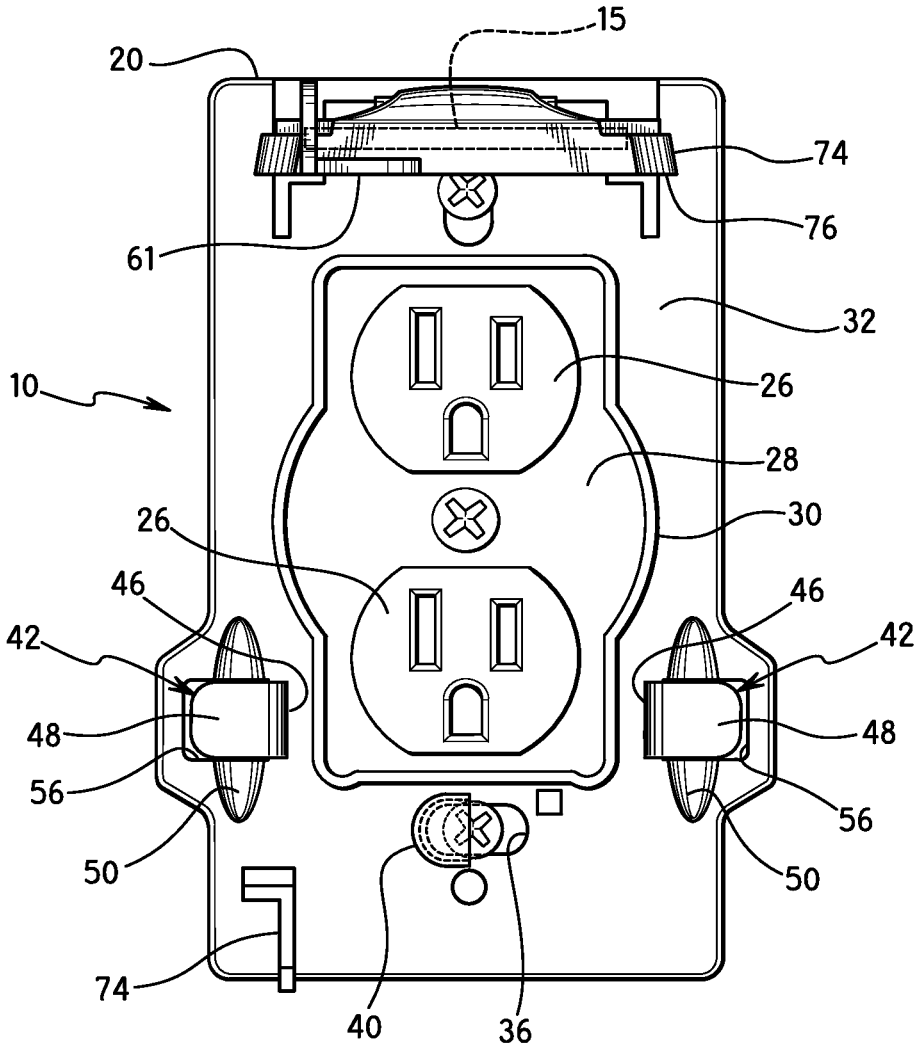
FIG. 5 is a front view of the cover assembly showing the cover in the open position to access the electrical receptacle.
Figure 6:
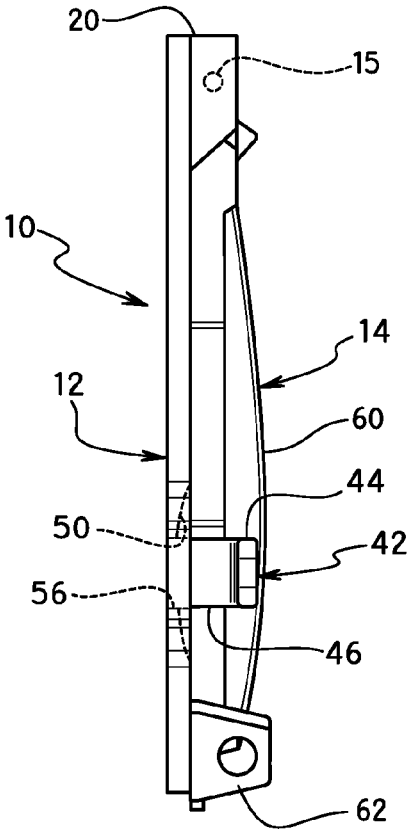
FIG. 6 is a side view of the cover assembly taken from the left side of FIG. 4.
Figure 7:
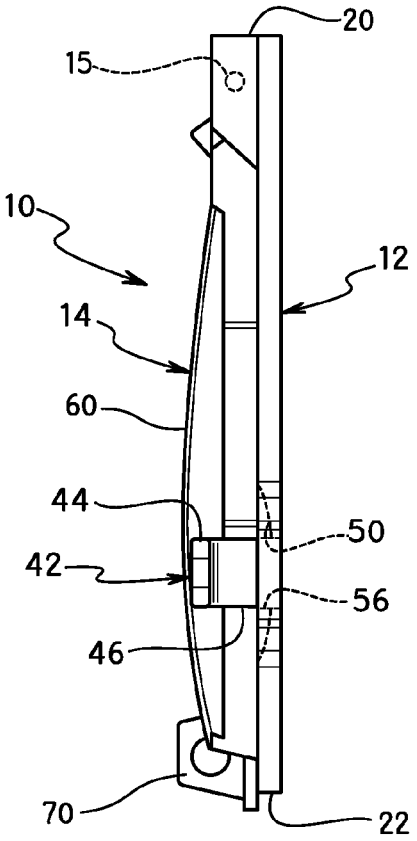
FIG. 7 is a side view of the cover assembly taken from the right side of FIG. 4.
Figure 8:
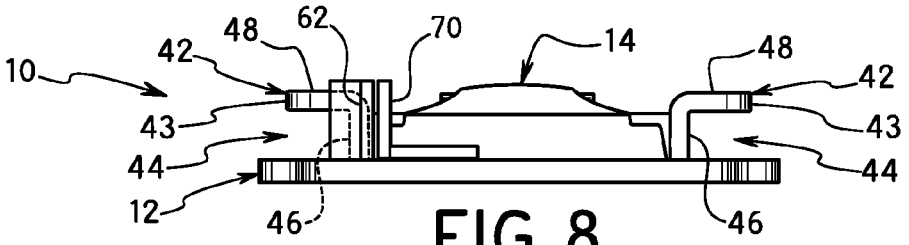
FIG. 8 is an end view of the cover assembly taken from the bottom side of FIG. 4.
Figure 9:
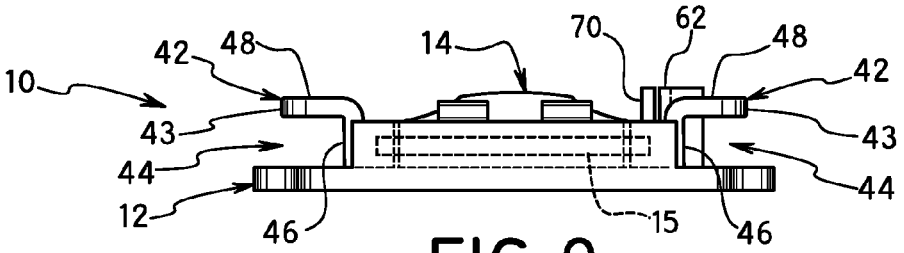
FIG. 9 is in view of the cover assembly taken from the top side of FIG. 4.

The base 12 in the embodiment of FIGS. 1-9 includes at least one and preferably two cord retention members 42. The cord retention members 42 are positioned toward an outer edge of the base 12 and outwardly from the rib 30. In the embodiment shown, the cord retention members 42 are positioned between the rib 30 and the outer edges of the base. As shown in FIG. 4, the cord retention members 42 are positioned adjacent the first side edge 16 second side edge 18 on opposite sides of the opening 24 and the rib 30. In one embodiment, a first cord retention member 42 is positioned between the rib 30 and the first side edge 16 and a second cord retention member 42 is positioned between rib 30 and second side edge 18. Preferably, the cord retention members 42 are positioned proximate a first side and second side of the cover assembly 10.

The cord retention members 42 in the embodiment shown form a cord hook 43 having an opening 44 with a dimension for receiving an electrical cord 52 and gripping the electrical cord 52 to hold the electrical cord in place and resist inadvertent separation of a connector, such as a plug 54 from the electrical receptacle 26 when the plug 54 is connected to the electrical receptacle 26. The cord retention members 42 in the embodiment shown have a first leg 46 extending outwardly from the front face 32 of the base 12 and a second leg 48 extending from the first leg 46 to define the cord hook. In one embodiment, the second leg 48 extends substantially perpendicular from the first leg 46 in a direction toward the respective side edge of the base 12. The second leg 48 is preferably spaced from the front face 32 of the base 12 a distance to capture the electrical cord 52 between the inner surface of the second leg 48 and the front face 32 of the base 12 as shown in FIG. 3.

In one embodiment shown in the figures, the front face 32 has a depression forming a cord recess 50 opposite the inner face of the second leg 48. The cord recess 50 has a shape and dimension for receiving the electrical cord to assisting gripping the cord between the second leg 48 of the cord retention member 42 and the front face 32 of the base 12. The first leg 46 and the second leg 48 of the cord retention members 42 define a hook-like shape for hooking the electrical cord 52 to the base 12. The cord recess 50 as shown in FIGS. 1 and 2 extends in a longitudinal direction with respect to a longitudinal dimension of the base 12 and has a longitudinal length greater than a longitudinal dimension of the cord retention member 42. An aperture 56 is provided in the front face 32 of the base 12 opposite the inner surface of the second leg 48. In the embodiment shown, the aperture 56 has a size and shape corresponding substantially to the dimensions of the second leg 48 of the cord retention member 42. In the embodiment shown, a flange 57 extends outwardly from the side edges of the base 12 proximate the aperture 56 to provide sufficient strength to the base surrounding the apertures 56 and to provide additional surface area for receiving and gripping the electrical cord 50.

The cover 14 has a shape and dimension to mate with the base 12 and to cover and enclose the opening 24 when the cover is in the closed position. In the embodiment shown, the cover 14 has an overall dimension less than the overall dimensions of the base 12 so that the outer edges of the cover are spaced inwardly from the outer edges of the base and outwardly from the rib 30 as shown in FIG. 4.

The cover 14 has a front face 60 a first side edge 62 and a second side edge 64. The cover 14 has a first end 66 and a second end 68 extending between the first side edge 62 in the second side edge 64. In the embodiment shown, the first end 60 is coupled to the base 12 by the hinge pin 15 to pivot the cover 14 with respect to the base 12. The cover 14 is provided with a locking tab 70 which mates with a locking tab 72 on the base 12 to enable locking the cover in the closed position.

The cover 14 has a rear face 61 opposite the front face 60 that mates with the front face 32 of the base and the rib 30 to form a weatherproof seal between the cover 14 in the base 12. The rear face 61 of the cover 14 can include a gasket member as known in the art to form a continuous seal with the rib 30. In a preferred embodiment of the invention, the cover 14 has a continuous outer edge 76 at the rear face 61 with no openings or gaps so that the cover 14 forms a continuous seal with the rib 30 with no gaps or openings between the base 12 and the cover 14 when the cover is in the closed position as shown in FIG. 1.

The cover 14 has a dimension to fit on the base 12 and inside and between the cord retention members 42 as shown in FIG. 4. The first side edge 62 of the cover 14 is between the cord retention member 42 on the first side edge 16 of the base 12 and the rib 30. The second side edge 64 of the cover 12 is positioned between the cord retention member 42 at the second side edge 18 of the base 12 and the rib 30 when the cover 14 is in the closed position.

During use, the cover assembly 10 is mounted to an electrical box and an electrical receptacle in a manner known in the art of weatherproof covers. In the embodiment shown, the base 12 has a substantially flat planar configuration such that the front face 32 of the base 12 is substantially flat between the rib 32 and the outer edges of the base. The cover 14 also has a substantially flat planar configuration to provide a low-profile cover assembly when mounted to the electrical device. As shown in FIG. 1, the cover 14 has a continuous sidewall 74 that extends from the front face 60 towards the rear face 61. The continuous sidewall 74 has a height to provide the low-profile and has no openings or gaps to form the continuous edge 76 for mating with the front face 32 of the base 12 and surrounding the opening 24 and the rib 30. The electrical receptacle 26 has a front face that extends into the opening 24 a distance so that the electrical receptacle 26 does not interfere with the closing of the cover 14 with respect to the base 12.

The electrical plug 54 is connected to the electrical receptacle 26 as shown in FIG. 3 which prevents the cover 14 from closing on the base 12. The electrical cord 52 is then hooked to one of the cord retention members 42 as shown in FIG. 3 to provide strain relief for the cord and prevent inadvertent separation of the plug 54 from the electrical receptacle 26. In the embodiment shown, the electrical receptacle 26 and the cover assembly 10 are provided for a duplex receptacle to receive two plugs as needed. The cover assembly 10 preferably includes two cord retention members 42 for receiving a cord connected to the electrical receptacle 26. In the embodiment shown, the cord retention members 42 are positioned adjacent or next to the side edges 16 and 18 of the base 12 toward the bottom end 22. In alternative embodiments, the cord retention members 42 can be positioned in other locations on the base 12 between the outer edge of the cover 14 and the outer edge of the base 12 where the cord retention members 42 do not interfere with the opening and closing of the cover 14 with respect to the base 12.

FIGS. 10-17 show a second embodiment of the cover assembly 80 having a base 82 and a cover 84 hinged to the base 82 by a hinge pin as in the previous embodiment. The base 82 in the embodiment shown has a rectangular configuration with a first side edge 86 and a second side edge 88 forming first and second sides of the cover assembly 80. A first end 90 at a top edge and a second end 92 at a bottom edge extend between the side edges. An opening 94 is provided in the central portion of the front face 96 of the base 82 extending between a front face and rear face of the base 82. The opening 94 has a dimension to receive the front face of an electrical receptacle 98. As in the previous embodiment, an adapter plate 100 can be attached to the base 82 in the opening 94 to accommodate different electrical devices.

A continuous rib 102 extends outwardly from the front face 96 of the base 82 and surrounds the opening 94. The rib 102 extends outwardly from the front face 96 a distance to provide a weatherproof seal with the cover 84. As in the previous embodiment, a keyhole shaped slot 104 and a screw hole 106 are provided for receiving a screw 107 and attaching the cover assembly 82 and electrical box and electrical receptacle.

Figure 10:
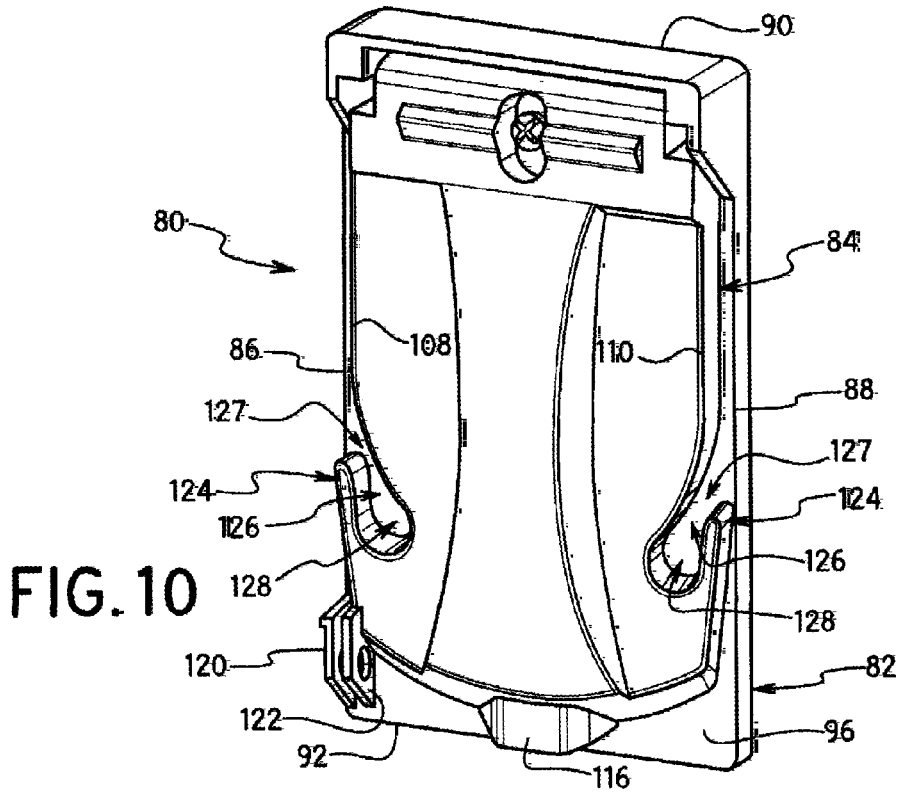
FIG. 10 is a perspective view of the cover assembly second embodiment of the invention.
Figure 11:
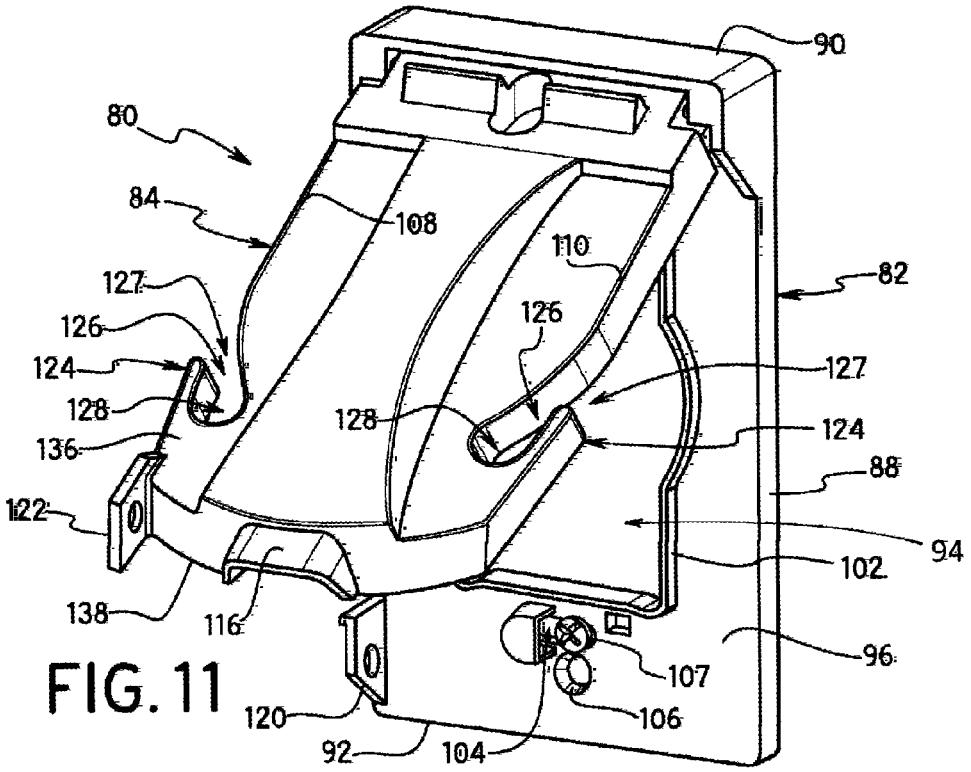
FIG. 11 is a perspective view of the cover assembly of FIG. 10 showing the cover in the partially open position.

The cover 84 is coupled to the top edge 90 of the base 82 by a hinge pin to enable the cover 84 to pivot between a closed position shown in FIG. 10 and an open position shown in FIG. 11 to allow access to the electrical receptacle 98.

Figure 12:
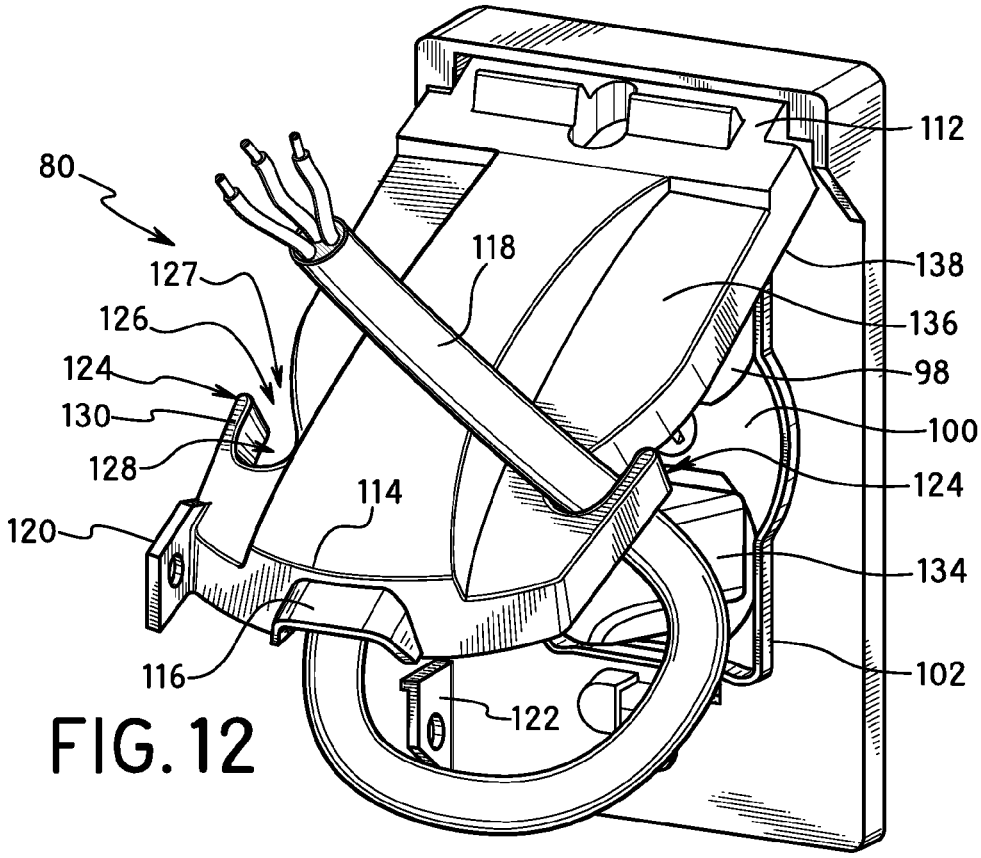
FIG. 12 is a perspective view of the cover assembly of FIG. 10 showing an electrical cord received in the cord retention member on the cover.
Figure 13:
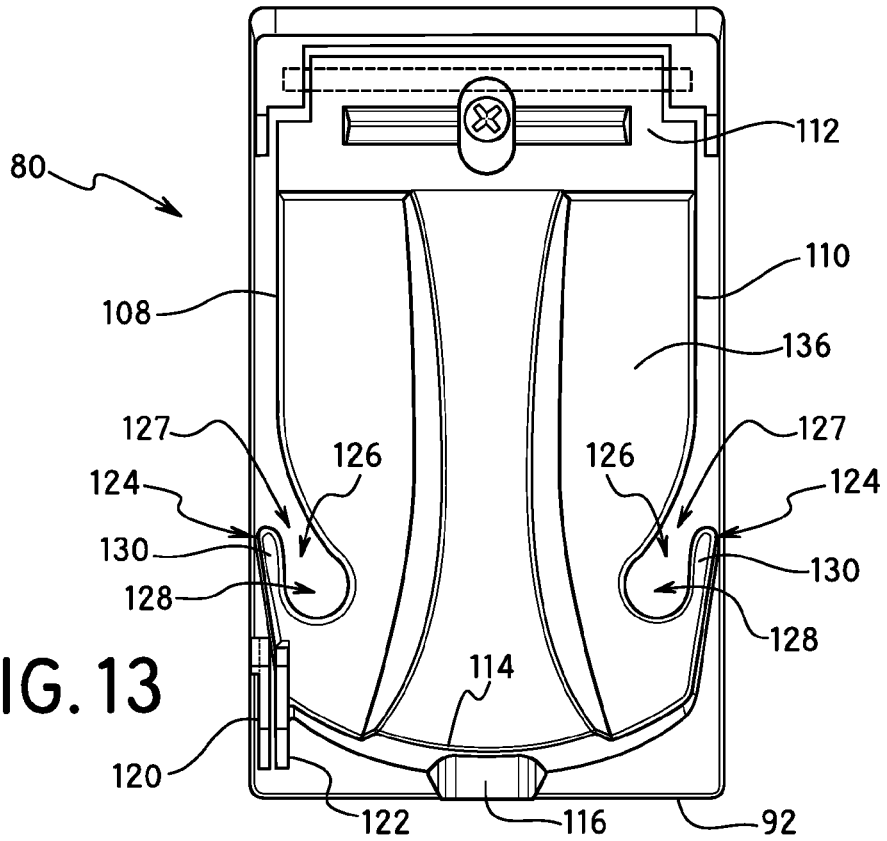
FIG. 13 is a front view of the cover assembly FIG. 10.
Figure 14:
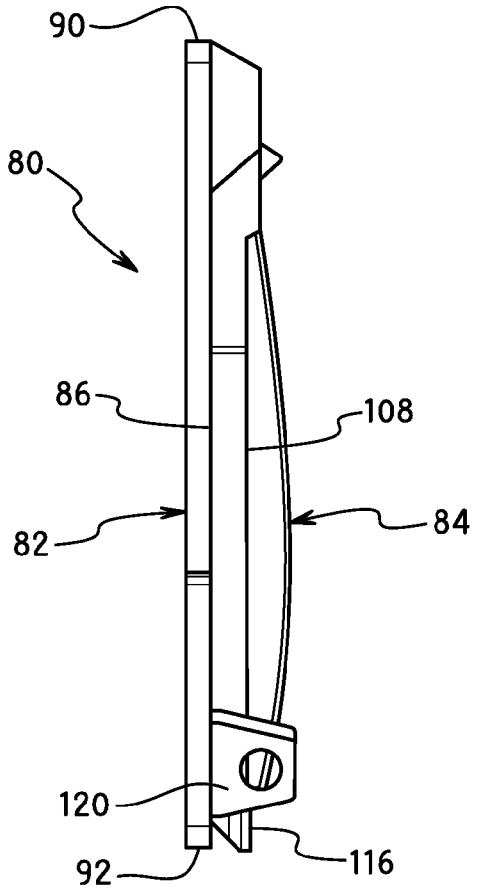
FIG. 14 is a left side view of the cover assembly of FIG. 10.
Figure 15:
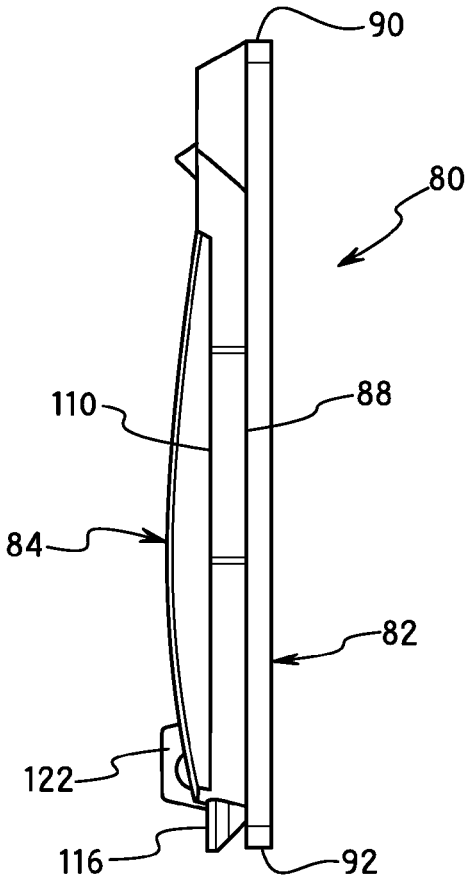
FIG. 15 is a right side view of the cover assembly of FIG. 10.
Figure 16:
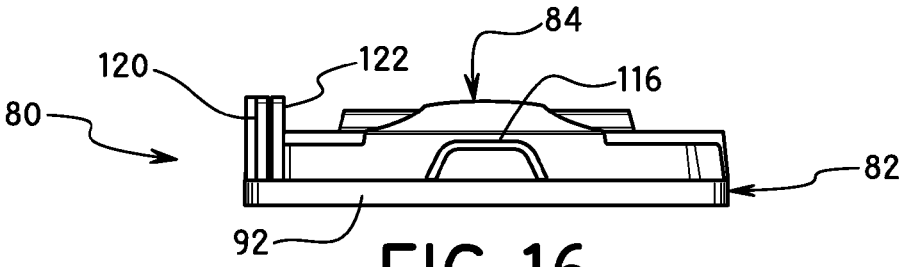
FIG. 16 is a bottom in view of the cover assembly of FIG. 10.
Figure 17:
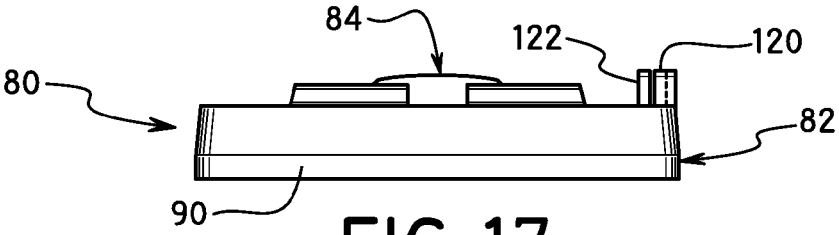
FIG. 17 is a top in view of the cover assembly of FIG. 10.

The cover 84 as a shape and dimension complementing the shape and dimension of the base 82. In the embodiment shown, the cover 84 has a dimension to fit within the perimeter of the base 82 so that the cover 84 does not extend beyond the perimeter of the base 82. The cover 84 has an outer edge including a first side edge 108 and an opposite second side edge 110. A first end 112 at a top edge and a second end 114 at a bottom edge extend between the side edges 108 and 110. The second end 114 has a substantially U-shaped recess and an inverted U-shaped shield 116 extending outwardly from the second end 114 to receive an electrical cord 118 as shown in FIG. 12. A locking tab 120 extends from the second end 114 proximate the first side edge 108 which mates with a locking tab 122 on the base 82 to lock the cover in the closed position.

The cover 84 has an outer edge with at least one and preferably two cord retention members 124. In the embodiment shown, the first side edge 108 and second side edge 110 of the cover 84 each include a cord retention member 124. The cord retention member 124 is formed by slot 126 having an opening 127 formed in the respective side edge of the cover 84. The slot 126 has a first open area 128 with a dimension to receive and grip the electrical cord 118. The opening 127 of the slot 126 is defined by a tab 130 that is oriented to provide a narrow opening to allow the cord 118 to slide into the first open area 128. The opening 127 has a width less than the dimension of the first open area 128 and less than the diameter of the cord 118 to allow the cord 118 to slide into the slot 126 and retain the cord in the first open area 128 as shown in FIG. 12.

In the embodiment shown, the slot 126 is formed at an inclined angle with respect to the first side edge 108 and second side edge 110 of the cover 84. In one preferred embodiment, the slot 126 has the opening 127 facing or angled toward the first end 112 of the cover 84 and the first end 90 of the base 82 so that the open end faces in a generally upward direction when mounted to the electrical box in a vertical orientation. In the embodiment shown, the slot 126 has a longitudinal dimension extending at an inclined angle with respect to the side edges of the cover and the side edges of the base. In this manner, an electrical plug 134 is connected to the electrical receptacle 98 and the cord 118 is hooked into the slot 126 by pulling the cord in a generally downward direction with respect to the cover assembly 80 when mounted in a vertical direction. In alternative embodiments, the slot of the cord retention member can be oriented along an axis substantially perpendicular to the side edges of the cover or in a generally upward direction.

In preferred embodiments of the invention, the slots 126 forming a cord retention member 124 are oriented in the cover 84 so that the open slots 126 are positioned outwardly from the opening 94 in the base 82 and positioned outwardly with respect to the electrical receptacle received in the opening 94. The slots 126 form an opening extending between the front face 136 and a rear face 138. The slots 126 are oriented in the cover 84 so that the open slots 126 do not overlie the electrical receptacle 98 and the opening 94 when the cover 84 is in the closed position as shown in FIG. 10. In the embodiment illustrated, the cord retention members 124 formed by the slots 126 are positioned in the side edges of the cover between the rib 102 of the base 82 and the peripheral edge of the base 82 to prevent rainwater from accessing the electrical receptacle 98 when the cover is in the closed position. In alternative embodiments, the cord retention members 124 can be formed in the end 92 of the cover 84. The cover 84 preferably includes a gasket material on the rear face as known in the art to form a weatherproof seal between the cover and the rib 102 when the cover is in the closed position.

While various embodiments have been chosen to illustrate the invention, it will be understood by those skilled in the art that various changes and modifications can be made without departing from the scope of the invention as defined in the appended claims.

What is claimed is:

1. A cover assembly for an electrical wiring device comprising;

a base having a front face, a first side, a second side, a first end, a second end, and an opening in said front face for receiving the electrical wiring device;

a cover hinged to said base and being pivotable between an open position providing access to said opening and a closed position covering said opening; and a first cord retention member positioned on said base near said second end and proximate said first side, wherein said first cord retention member comprises a first leg extending outwardly from said front face of said base and a second leg extending from said first leg and being spaced from said front face, wherein said first leg and said second leg form an opening with a dimension for gripping an electrical cord.

2. The cover assembly of claim 1, further comprising a second cord retention member positioned on said base near said second end and proximate said second side, wherein said second cord retention member comprises a first leg extending outwardly from said front face of said base and a second lea extending from said first leg and being spaced from said front face, wherein said first leg and said second leg of said second cord retention member form an opening with a dimension for gripping an electrical cord.

3. The cover assembly of claim 2, wherein said first and second cord retention members are positioned between a rib of said base and said first side and second side, respectively, of said base to receive an electrical cord.

4. The cover assembly of claim 2, wherein said cover has a first end hinged to said first end of the base and a second end mating with said second end of said base.

5. The cover assembly of claim 2, further comprising a rib extending outwardly from said base and surrounding said opening in said base, and wherein said cover has a dimension to surround said rib when said cover is in said closed position, and said first and second cord retention members are spaced outwardly from said rib and cover when said cover is in the closed position.

6. The cover assembly of claim 1, wherein said first cord retention member and said second cord retention member are integrally formed with said base.

7. The cover assembly of claim 1, wherein said second leg of said first cord retention member is substantially parallel to said front face of said base, and said second leg of said second cord retention member is substantially parallel to said front face of said base.

8. The cover assembly of claim 1, wherein said base includes a first recess, and said second leg of said first cord retention member overlies said first recess, and said base includes a second recess, and said second leg of second cord retention member overlies said second recess.

9. The cover assembly of claim 1, wherein said second leg of said first cord retention member extends outwardly toward said first side of said base, and said second leg of said second cord retention member extends outwardly toward said second side of said base.

10. A cover assembly for an electrical wiring device comprising;

a base having a front face, a first side, a second side, a first end, a second end, and an opening in said front face for receiving the electrical wiring device;

a cover having a first end hinged to said first end of said base and a second end opposite said first end, said cover being pivotable between an open position providing access to said opening and a closed position covering said opening, said cover having an outer edge;

a first cord retention member on said outer edge of said cover and having an opening facing outwardly from said outer edge and having a dimension for gripping an electrical cord independent of said base; and a rib extending outwardly from said front face of said base and surrounding said opening in said base, and where said cover has a dimension to surround said rib when said cover is in the closed position.

11. The cover assembly of claim 10, further comprising:

a second cord retention member on said outer edge of said cover and having an opening facing outwardly from said outer edge and having a dimension for gripping an electrical cord independent of said base.

12. The cover assembly of claim 11, wherein said first cord retention member is formed by a first slot in a first side edge of said cover, said second cord retention member is formed by a second slot in a second side edge of said cover, said first slot is oriented with the opening facing toward said first end of said cover, and said second slot is oriented with the opening facing toward said first end of said cover.

13. The cover assembly of claim 12, wherein said first slot comprises the opening for receiving the electrical cord and an open area for retaining the electrical cord, said open area having a dimension greater than a dimension of said opening and where said opening and said open area extend between a front face of said cover and a rear face of said cover; and said second slot comprises the opening for receiving the cord and an open area for retaining the cord, said open area having a dimension greater than a dimension of said opening, and where said opening and said open area extend between said front face and rear face of said cover.

14. The cover assembly of claim 13, wherein said first slot and said second slot are positioned on said cover to lie between said rib and said first side and second side of said base, respectively, when said cover is in the closed position.

15. A cover assembly for covering an electrical receptacle configured for receiving an electrical cord, said cover assembly comprising:

a base having a front face with a first recess for receiving an electrical cord, a rear face, a first side and a second side opposite said first side, a first end, a second end, and an opening in said front face for receiving an electrical receptacle;

a cover hinged to said first end of said base, said cover being pivotable between an open position and closed position to cover said opening in said base, said cover having a first side edge and second side edge; and a first cord retention member having a first leg attached to and extending outwardly from said front face of said base, and a second leg coupled to said first leg, wherein said second leg extends outwardly from said opening, is substantially parallel to said front face of said base, and is spaced from said front face a distance to grip an electrical cord, and wherein said second leg of said first cord retention member overlies said first recess.

16. The cover assembly of claim 15, further comprising a second recess in said front face for receiving an electrical cord; and a second cord retention member having a first leg attached to and extending outwardly from said front face of said base, and a second leg coupled to said first leg, wherein said second leg extends outwardly from said opening, is substantially parallel to said front face of said base, and is spaced from said front face a distance to grip an electrical cord, and wherein said second leg of said second cord retention member overlies said second recess.

17. The cover assembly of claim 16, wherein said first cord retention member is positioned between said first side of said base and said first side edge of said cover when said cover is in the closed position, and said second cord retention member is positioned between said second side of said base and said second side edge of said cover when said cover is in the closed position.

18. The cover assembly of claim 17, wherein said first cord retention member is positioned on said first side of said base and said second cord retention member is positioned on said second side of said base.

19. The cover assembly of claim 16, wherein said second leg of said first cord retention member extends toward said first side of said base, and said second leg of said second cord retention member extends toward said second side of said base.

* * * * *